US005590726A

United States Patent [19]

Jarvela et al.

[11] Patent Number: 5,590,726

[45] Date of Patent: Jan. 7, 1997

[54] DRILLING APPARATUS

[76] Inventors: Jorma Jarvela, Paavalinkuja 3 C 15, FIN-33300 Tampere; Vesa Jarvela, Friisilantie 34 A, Fin-02240, Espoo, both of Finland

[21] Appl. No.: 446,870

[22] PCT Filed: Dec. 1, 1993

[86] PCT No.: PCT/FI93/00512

§ 371 Date: Jun. 5, 1995

§ 102(e) Date: Jun. 5, 1995

[87] PCT Pub. No.: WO94/12760

PCT Pub. Date: Jun. 9, 1994

[30] Foreign Application Priority Data

| | | | |
|---|---|---|---|
| Dec. 3, 1992 | [FI] | Finland | 925491 |
| Jul. 5, 1993 | [FI] | Finland | 933074 |

[51] Int. Cl.[6] ..... E21B 10/38; E21B 10/64

[52] U.S. Cl. ..... 175/257; 175/415

[58] Field of Search ..... 175/257, 258, 175/259, 171, 415, 22, 23

[56] References Cited

U.S. PATENT DOCUMENTS

| | | | |
|---|---|---|---|
| 2,675,213 | 4/1954 | Poole et al. | 175/257 |
| 3,190,378 | 6/1965 | Davey, Sr. et al. | 175/257 |
| 3,409,081 | 11/1968 | Brown | 175/257 |
| 3,732,143 | 5/1973 | Joosse | 175/171 |
| 3,901,331 | 8/1975 | Djurovic | 175/258 |
| 3,933,209 | 1/1976 | Sweeney | 175/257 |

FOREIGN PATENT DOCUMENTS

| | | | |
|---|---|---|---|
| 2004459 | 8/1971 | Germany . | |
| 2824722 | 12/1979 | Germany | 175/171 |
| 223486 | 11/1968 | Sweden . | |
| 959955 | 6/1964 | United Kingdom . | |
| 1068638 | 5/1971 | United Kingdom . | |

OTHER PUBLICATIONS

Mining Magazine, vol. 168, No. 10, Oct. 1993 (London), "New Method of Soil and Overburden Drilling", pp. 218–219.

*Primary Examiner*—Hoang C. Dang

*Attorney, Agent, or Firm*—Pollock, Vande Sande & Priddy

[57] ABSTRACT

A drilling apparatus adapted to be fed into a hole to be drilled and extendable in a longitudinal direction includes a casing and a drilling unit. A drilling head of the drilling unit includes a first drilling unit for drilling a center hole and a second drilling unit for reaming the center hole for the casing, the first drilling unit attachably connected to the second drilling unit at the drilling head. A counterpart assembly transmits rotational and impact movement from the first to the second drilling unit. A coupling assembly connects the second drilling unit with a head of the casing such that the second drilling unit freely rotates centrically around a longitudinal axis. A flushing unit for removal of drilling waste comprises at least one first passage extending through the first drilling unit to a drilling point, and communicates with at least one flow channel for transferring flushing medium to a drilling surface and the drilling point. At least one second passage for removal of the drilling waste is formed between the drilling surfaces of the first and second drilling units. A first component of the counterpart assembly is located at the outer surface of the first drilling unit for locking the first and second drilling unit together by a bayonet principle to rotate these units together and to move them together in both longitudinal directions. The at least one second passage is partially formed by the first component of the counterpart assembly.

8 Claims, 3 Drawing Sheets

DRILLING APPARATUS

BACKGROUND OF THE INVENTION

The invention relates to a drilling apparatus including a drilling device that is intended to be fed into a hole to be drilled and which is preferably extendable in the longitudinal direction. The drilling device comprises a casing part essentially inside of which there is at least during a drilling situation a drilling unit in the drilling head of which there are at least a first drilling means for drilling a center hole and a second drilling means for reaming the center hole for the casing part as well as a flushing means for removal of the drilling waste. At least during the drilling situation the rotational movement around the longitudinal axis and the impact movement in the longitudinal direction of the first drilling means is transmitted by a counterpart assembly to the second drilling means that is drivingly connected to the first drilling means essentially at the drilling head of the drilling unit, wherein the second drilling means is arranged to rotate in connection with the head of the casing part centrically around the longitudinal axis by a coupling assembly. The first drilling means is arranged detachable from the second drilling means for removing the first drilling means from the prepared hole, while at least the second drilling means is left in the bottom of the hole.

Patent Publications GB-959955 and GB-1068638 disclose drilling arrangements such as above. The solutions described in both mentioned publications comprise inner drilling means, in other words the center drill for drilling the centerhole and outer drilling means that is symmetrical in relation to the longitudinal axis of the drill and the leaving of which in the hole together with the casing part after the drilling situation is made possible. In such an arrangement, thanks to the centrical rotation movement of the outer drilling means or in other words the reaming drill, the risk of breakage of the drilling arrangement is rather small, especially compared with currently widely used drilling arrangements having eccentric reaming drills.

The contact surface of the reaming drill according to the solution presented in the Patent Publication GB-959955 touches the head of the casing part from the inside. In this case the effective diameter of the center drill is reduced also by twist locking and impact surface assemblies between the center drill and the reaming drill. The mentioned publication presents two differing solutions, wherein a shape locking has been applied as the twist locking assembly in the first solution between the drilling means and in the other one a bayonet coupling between the same. Accordingly, the impact surface assembly comprises a recess-projection assembly between the reaming drill and the center drill that is situated in the front edge of the said twist locking assembly. In a solution described above, the casing part has to be fed into the hole to be drilled by influence of the center drill, wherein the feeding movement is transmitted by means of the counterpart assembly through the reaming drill, in which case the casing part follows the reaming drill. Thus it is practically possible that the impact movement of the center drill is transmitted at least partially also directly to the casing part.

The Patent Publication GB-1068638 discloses a solution in which the reaming drill is placed end to end with the head of the casing part. In this case there is an internal socket fixed in the reaming drill, which is placed in contact with the inner surface of the head of the casing part. In the head of the casing part and in the socket there is a recess-projection assembly, by influence of which the socket remains in place in the longitudinal direction, however allowing rotation of the socket in relation to the casing part. In the solution above there has also been applied an additional block in connection with the arm of the center drill, which couples the rotational movement, feeding movement and impact movement of the center drill to the reaming drill by influence of the socket.

It is common to solutions according to those above that the effective diameter of the center drill is relatively small, that is about 50% of the inner diameter of the casing part. Naturally this is why it is necessary to apply excessively massive drilling rods, which naturally raises the manufacturing costs of the drilling arrangement explained above. Additionally the massiveness of the constructions is also a reason why the handling of the parts of the drilling arrangement is difficult, besides the usage of which demands high capacity. That is why the solutions of above explained types have currently not been used too much in practice, though a centrically rotating reaming drill has many significant advantages compared especially with a so called eccentric reaming drills.

SUMMARY OF THE INVENTION

It is an aim of the drilling apparatus according to this invention to achieve a decisive improvement in the problems presented above and thus to raise substantially the level of knowledge in the field. To achieve this aim, the drilling apparatus according to the invention is primarily characterized in that for optimizing at least the size of the first drilling means, the effective diameter of the first drilling means, the effective diameter of the first drilling means is at least 60%, preferably more than 75% of the inner diameter of the casing part.

The most important advantages of the drilling apparatus according to the invention are the simplicity and reliability of its construction and usage, wherein especially thanks to the centrical rotation movement of the reaming drill the operational capacity may be optimized in the usage of the drilling apparatus. Thanks to the advantageous operating principle in the sense of the strength of the construction, it is additionally possible to increase the useful life of the drilling unit compared to currently used solutions. Thanks to the invention, it is possible to optimize the proportions of the center drill and the reaming drill in such a way that the whole drilling apparatus and the parts that belong to it are easy to handle and do not require disproportionate operational capacity. However, the center drill of the drilling apparatus according to the invention may, when needed, be arranged to be even more massive than the present center drills and/or the produced waste may be led through the drilling surface of the same inside the casing part. In addition, in the drilling apparatus according to the invention it is possible with simple arrangements to couple the reaming drill to the casing part in such a way that not only the center drill but also the casing part may be removed from the produced hole, thus having only the reaming drill in the hole.

Advantageous embodiments of the drilling apparatus according to the invention are presented in the other dependent claims.

BRIEF DESCRIPTION OF THE DRAWINGS

In the following description, the invention is illustrated in detail with reference to the appended drawings. In the drawings.

DESCRIPTION OF THE PREFERRED EMBODIMENTS

Figure 1:
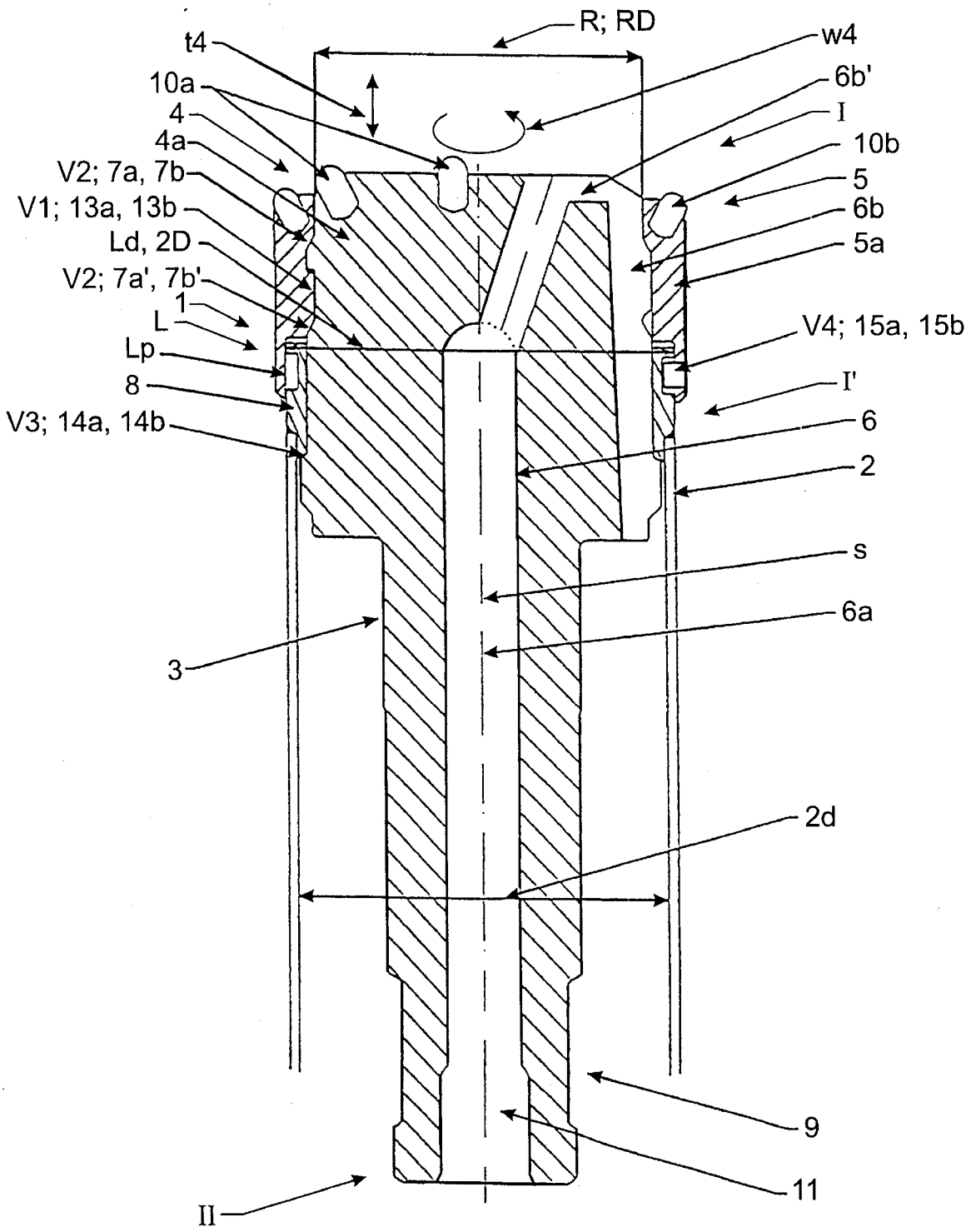
FIG. 1 shows a longitudinal section of the drilling head of one advantageous drilling apparatus according to the invention.

The drilling apparatus comprises a drilling device 1 that is intended to be fed into a hole to be drilled and which is preferably extendable in the longitudinal direction s, wherein the drilling device comprises a casing part 2 essentially inside of which there is at least during a drilling situation a drilling unit 3. In the drilling head I of the drilling unit 3 there are at east a first drilling means 4 for drilling a center hole R and a second drilling means 5 for reaming the center hole R for the casing part 2 as well as a flushing means 6 for removal of the drilling waste. At east during the drilling situation the rotational movement w4 around the longitudinal axis s and the impact movement t4 in the longitudinal direction of the first drilling means 4 is transmitted to the second drilling means 5 that is drivingly connected to the first drilling means 4 essentially at the drilling head I of the drilling unit 3. The second drilling means 5 is arranged to rotate in connection with the head I' of the casing part 2 centrically around the longitudinal axis s by a coupling assembly L. In addition the first drilling means 4 is arranged detachable from the second drilling means 5 for removing the first drilling means 4 from the prepared hole, while at least the second drilling means 5 is left in the bottom of the hole. For optimizing at least the size of the first drilling means 4, the effective diameter of the first drilling means 4 is at least 60%, preferably more than 75% of the inner diameter of the casing part.

In the advantageous embodiment presented in FIG. 1 the coupling surface Lp of the coupling assembly L in connection with the second drilling means 5 is arranged to touch the head I' of the casing part 2 from outside, wherein the inside dimension Ld of the coupling surface Lp is arranged preferably bigger than the inner diameter 2*d* of the casing part 2.

Further with reference to FIG. 1, the drilling head I of the drilling unit 3 consists at least of a first frame part 4*a* and a second frame part 5*a* to the drilling surfaces in which there are arranged drilling organs 10*a*, 10*b* of the first and second drilling means 4, 5, that are formed in the presented embodiment of separate drilling bits. At the second end II of the first frame part 4*a* there are at least fixing and junctioning assemblies 9, 11 for an impact device or a drilling rod to be connected and for the flushing medium to be led centrically. In this case the second end of the second frame part 5*a*, being an integrated part of the same, is arranged as a coupling surface Lp that surrounds the head I' of the casing part 2, the inside dimension Ld of which is advantageously as big as the outer diameter 2D of the casing part 2.

Figure 2:
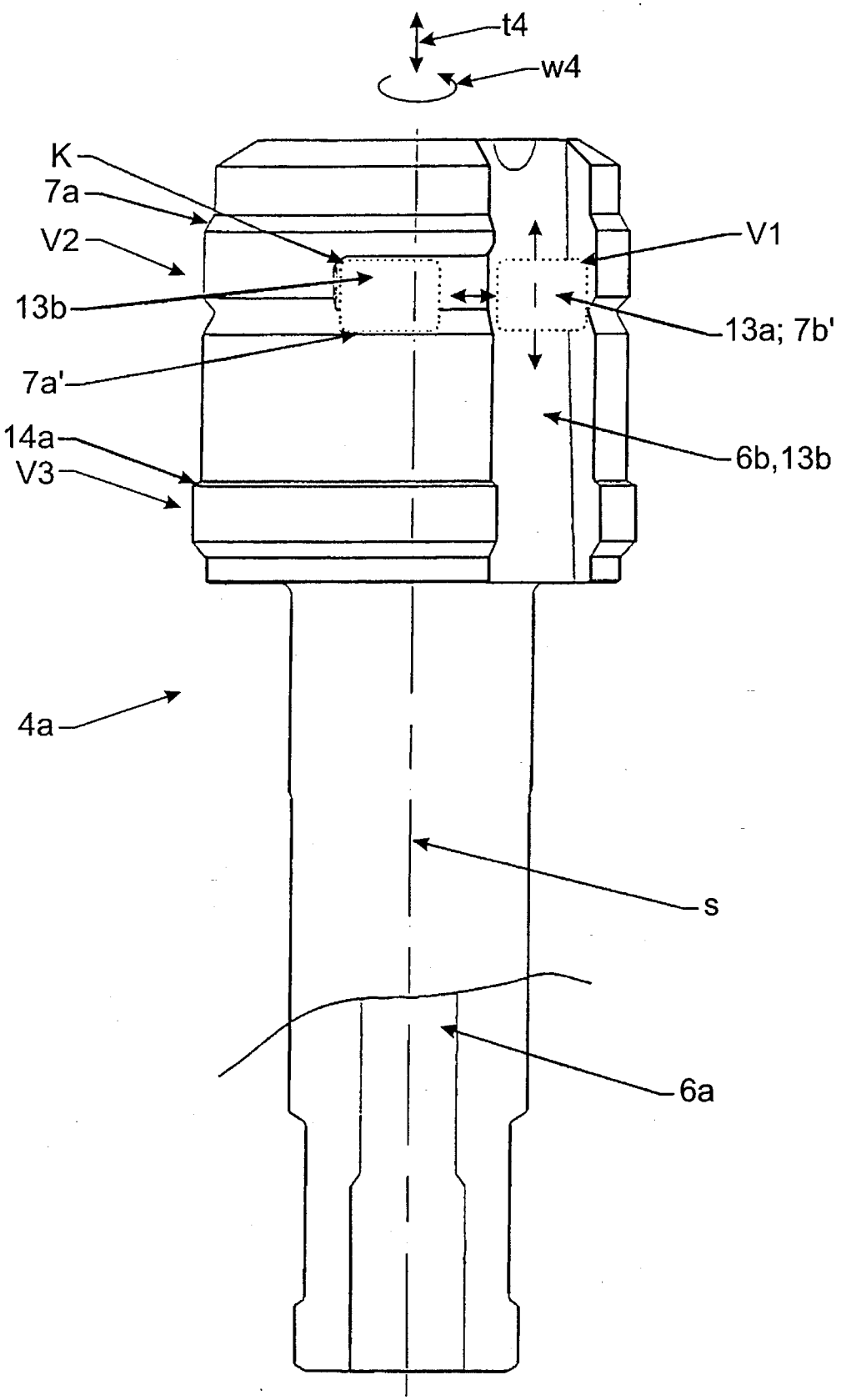
FIG. 2 shows a side view of the first frame part of the drilling apparatus presented in FIG. 1

Further, as an advantageous embodiment especially with reference to FIG. 2, onto the radial outer surface of the first frame part 4*a*, and onto the inner surface of the second frame part 5*a*, is arranged a first assembly V1 of the counterpart assembly, in other words a projection-recess assembly 13*a*, 13*b* as presented in FIGS. 1 and 2, on the one hand to rotate the second frame part 5*a* during the drilling situation by influence of the rotational movement w4 of the first frame part 4*a*, and on the other hand to separate the first frame part 4*a* after the drilling situation from the second frame part 5*a* in the longitudinal direction s. In addition, the counterpart assembly comprises a second assembly V2 that is a first recess-projection assembly 7*a*, 7*b*, to direct the impact movement t4 transmitted by the first frame part 4*a* to the second frame part 5*a*. The drilling surfaces of the first frame part 4*a* and of the second frame part 5*a* are arranged essentially in the same drilling plane, wherein the first recess-projection assembly 7*a*, 7*b* of the second assembly V2 is arranged advantageously in connection with the said drilling plane. In this way an optimized construction of the drilling head has been achieved, whereby the impact energy is transmitted as near as possible to the drilling surface of the reaming drill 5. On the other hand, the presented solution enables the relatively massive construction of the first frame part 4*a*, which matter is advantageous in the sense of operational durability.

In the presented embodiments the first organs 6*a* of the flushing means 6 for leading the flushing medium to the drilling point is arranged through the drilling surface of the first drilling means 4 by flow channels. In this case the flushing medium is led centrically through the second end II of the first frame part 4*a*, whereby it is led in the drilling head of the first frame part 4*a* advantageously via three flow channels eccentrically through the drilling surface. Thanks to the large cross sectional area of the first frame part 4*a* made possible by the invention, the second organs 6*b* of the flushing means 6 for scavenging of the drilling waste are arranged to lead the waste essentially through the drilling surface of the first drilling means 4 inside the casing part 2.

Figure 3:
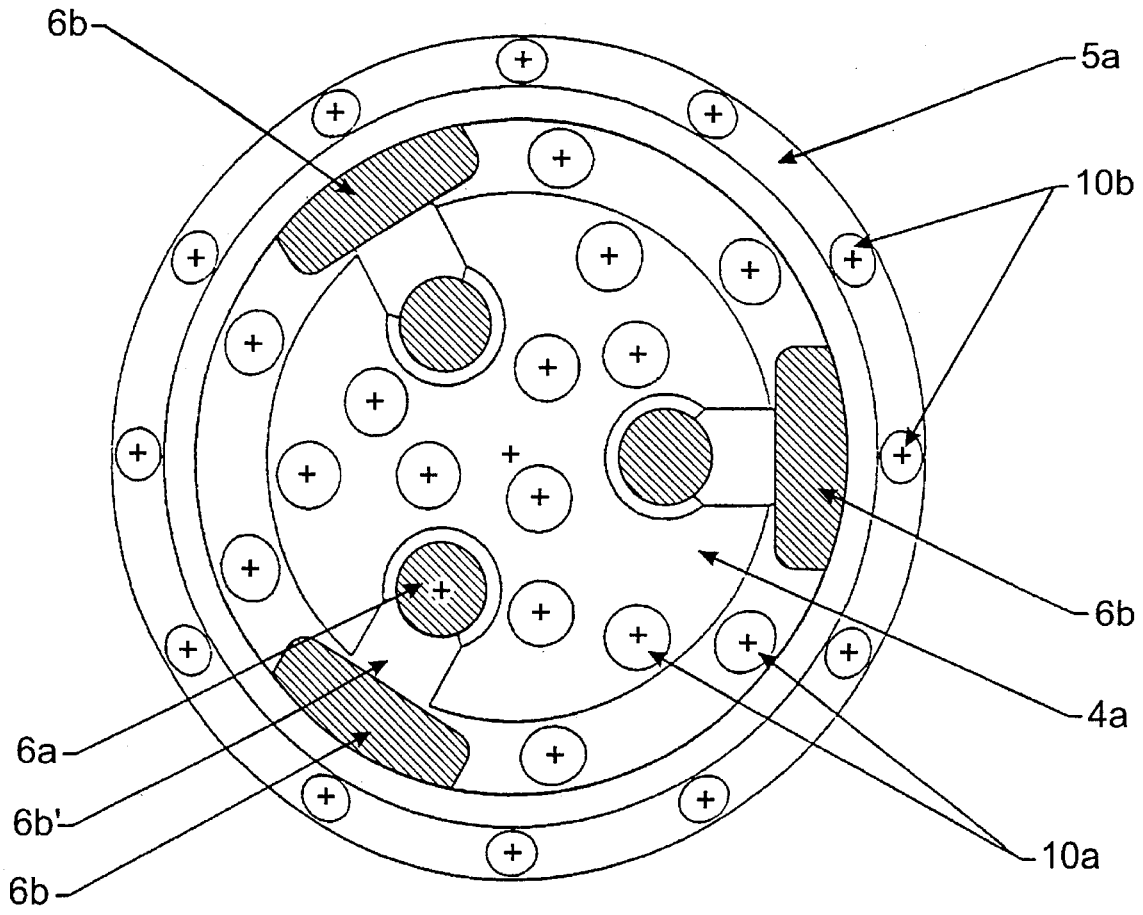
FIG. 3 shows the drilling head presented in FIG. 1 seen from the front.

With reference especially to FIG. 3, the second organs 6*b* of the flushing means 6 are arranged between the frame parts 4*a*, 5*a*, symmetrically as viewed in a cross section by three flow grooves being placed essentially in the longitudinal direction s on the outer surface of the first frame part 4*a*. Thus the impact surface of the assembly V2 transmitting the impact movement has been reduced by the second flushing organs 6*b*, which matter has been compensated for by adding to the construction advantageously at least one second recess-projection assembly 7*a*', 7*b*' that is placed in a distance from the first recess-projection assembly 7*a*, 7*b* in the longitudinal direction s. The presented embodiment in FIGS. 1 and 2, the said second recess-projection assembly is advantageously formed by the recess-projection assembly 13*a*, 13*b* that belongs to the first assembly V1 of the counterpart assembly. In this case the locking projection 13*a* is arranged, as presented in FIG. 2, to tighten against the back edge of the transverse locking recess 13*b* in the center drill 4*a* by arranging the front corner K of the end of the locking recess to be arched.

As an advantageous embodiment, the drilling unit 3 is arranged to operate by a rotational movement continuing essentially in the first direction w4, wherein for locking the first 4 and the second 5 drilling means to each other during the drilling situation the first assembly V1 of the counterpart assembly is advantageously arranged to operate by means of bayonet-principle by three projection-recess assemblies 13*a*, 13*b*. Thus the first drilling means 4 is arranged to be separated from the second drilling means 5 by turning the drilling unit 3 in the opposite direction will respect to the first direction w4 to open the longitudinal s locking of the first assembly V1, as presented in FIG. 2. In this case, as presented in FIGS. 2 and 3, the longitudinal recess assemblies 13*b* belonging to the first assembly V1 and being placed on the outer surface of the first frame part 4*a*, are formed by the flow grooves 6*b* functioning as the second organs of the flushing means. The said grooves 6b join, as presented in FIG. 1, to the flow channels 6a inside the center drill by transmitting channels 6b' that are situated on the drilling surface of the center drill.

Especially with reference to FIG. 1, as an advantageous embodiment there has been arranged an intermediate part 8, such as a casing shoe or the like, at the head I' of the casing part 2, the meaning of which is at least to reinforce the head I' of the casing part 2. Thus for at least to feed the casing part 2 into the hole, a recess-projection surface assembly 14a, 14b functioning as the third assembly V3 of the counterpart assembly is arranged in connection with the center drill 4a and the intermediate part 8.

Further, as an advantageous embodiment for coupling of the reaming drill 5a and the casing shoe 8 at the head of the casing part 2 to each other in a way allowing the free rotation and at least limiting the longitudinal movement of the same in relation to each other, a fourth assembly V4 of the counterpart assembly, such as a second recess-projection surface assembly 15a, 15b is arranged in connection with the said parts 5a, I'.

The above described solutions improve further the operation of the drilling apparatus in such a way that influence of the force feeding the casing part 2 into the hole is aimed from the center drill 4a directly to the head of the casing part 2 and not for example by the influence of the reaming drill, as is the case in traditional solutions. This makes it even possible to couple the casing shoe 8 and the reaming drill 5a detachably to each other in such a way that it is possible to leave only the reaming drill in the bottom of the prepared hole. In the presented solution this can be achieved by projections 15a that are connected to the reaming drill by means of spring force. Naturally the said projection 15a of the reaming drill may be formed of solid structure that is breakable by a certain force.

In practical tests it has been further proved advantageous to use special treatments at the contact surfaces of the counter part assembly, such as coating or face hardening. It is obvious that the invention is not limited to the embodiments presented above but it can be modified within the basic idea even to a great extent. Thus it is possible, for example, to apply in the drilling head of the drilling unit a greater number of frame parts than presented above, wherein for example the drilling bits may be connected to the head of the first frame part with an integrated cutting block. Naturally it is not necessary to use a separate intermediate part applied in the presented embodiments but the same kind of assemblies may be constructed by solid assemblies that are placed in the inside and/or outside surfaces of the head of the casing part. Correspondingly the intermediate part of the presented embodiment may be constructed in a way allowing its twisting movement with respect to the second frame part and at least partially limiting the mutual longitudinal movement of the same in such a way that the intermediate part rests on a guiding surface of the second frame part that reaches inside the casing part, whereby the second frame part further rests indirectly on a guiding projection of the first frame part.

Naturally the mutual counterpart assemblies between the drilling means, as well as between them and the casing part, may be constructed in most differing ways. Thus the first frame part and the second frame part may be connected to each other by for example a thread joint, wherein the locking between the same is achieved by mechanical, pressurized fluid and/or electrical assemblies. Naturally the parts may be connected to each other only by a thread joint, which solution however may cause problems in separating the parts from each other, because the parts will probably jam against each other too tightly during drilling. The frame parts may be connected by the quick coupling principle also in a way that there are teeths in both parts which fit to each other in the longitudinal direction. In such a case it is, however, not possible with simple arrangements to achieve the actual longitudinal locking between the frame parts. Then there is for example a risk that in certain operational situations the frame parts separate unintentionally, whereby additional stages are needed to couple them again. With the solution in question there is not a full certainty in every operational situation about the frame parts being inside each other long enough, in which case on the one hand the drilling result suffers, because the center drill does not reach far enough to drill, and on the other hand the toothing between the frame parts may get out of order by breakage.

Naturally the second drilling means may be connected only to the first drilling means, in which case there is a risk that the second drilling means turns into an unsuitable position at the bottom of the hole, in which case the first drilling means is removed from the hole, In the apparatus according to the invention, parts made of customary materials may be used that are produced applying in most differing methods of preparation. In addition for example an oscillating rotation movement may be applied as the drilling movement of the drilling apparatus.

We claim:

1. A drilling apparatus adapted to be fed into a hole to be drilled and extendable in a longitudinal direction, said drilling apparatus including a casing and a drilling unit essentially inside said casing at least during drilling, said drilling unit comprising a drilling head including:

a first drilling means for drilling a center hole;

a second drilling means for reaming the center hole for the casing, said first drilling means being connected to said second drilling means essentially at the drilling head and being detachable from said second drilling means for removal from the hole while said second drilling means is left in the hole;

a counterpart assembly for transmitting rotational and impact movement of said first drilling means to said second drilling means;

a coupling assembly for connecting said second drilling means with a head of the casing in a way that said second drilling means freely rotates centrically around a longitudinal axis with respect to said casing head;

a flushing means for removal of drilling waste, said flushing means comprising at least one first passage extending through said first drilling means to a drilling point, at least one flow channel in communication with said first passage for transferring flushing medium through said at least one first passage to a drilling surface of the first drilling means and further to said drilling point, and at least one second passage through which the drilling waste is removed, said at least one second passage essentially formed between said drilling surface of the first drilling means and a drilling surface of the second drilling means; and a first component of the counterpart assembly located at the outer surface of the first drilling means, for locking said first and second drilling means together by means of a bayonet principle to rotate said first and second drilling means together and move said first and second drilling means together in both longitudinal directions; and wherein said at least one second passage is partially formed by said first component of tile counterpart assembly.

2. A drilling apparatus according to claim 1, wherein said drilling head further comprises a first frame part and a second frame part on which are arranged said first and second drilling passage;

fixing and junctioning assemblies, located at a second end of the first frame part, for connecting to an impact device or a drilling rod and for transferring said flushing medium to said drilling point; and a second component of the counterpart assembly for directing impact movement transmitted at least by the first frame part to the second frame part, whereby said drilling surfaces of the first frame part and of the second frame part are arranged in the same drilling plane;

wherein said first component of the counterpart assembly is located on a radial outer surface of the first frame part and on a inner surface of the second frame part, for locking said first and second frame part together during drilling, for rotating the second frame part at least during drilling by influence of rotational movement of the first frame part, and for separating the first frame part, at least after drilling, from the second frame part in the longitudinal direction; and wherein the at least one second passage of the flushing means transfer the drilling waste essentially between the first and second frame parts by at least two flow grooves of said first component, said at least two flow grooves being placed symmetrically on the outer surface of the first frame part, as viewed in a cross section of the longitudinal direction.

3. A drilling apparatus according to claim 2 said drilling unit being operated by a rotational movement continuing essentially in a first direction, wherein the first component of the counterpart assembly locks the first and the second drilling means to each other by at least two projection-recess assemblies, whereby the first drilling means can be separated from the second drilling means by turning the drilling unit in an opposite direction of said first direction to open the longitudinal locking of the first component, and wherein said flow grooves of the first component of the counterpart assembly are at least partially formed from longitudinal recess assemblies of the first component placed on the outer surface of the first frame part.

4. A drilling apparatus according to claim 3, wherein said second component comprises at least one first recess-projection assembly that is placed at a distance from a second recess-projection assembly in the longitudinal direction for compensating for reduction of an impact surface of the second component due to the second flushing passage.

5. A drilling apparatus according to claim 4, wherein said first recess-projection assembly is at least partly formed from a projection-recess assembly of the first component of the counterpart assembly.

6. A drilling apparatus according to claim 5, further comprising a locking projection of the first component for tightening against a back edge of a transverse locking recess of the first component by arching at least a corner of the end of the locking recess.

7. A drilling apparatus according to claim 2, further comprising a casing shoe at the head of the casing for reinforcing the head of the casing; and a recess-projection surface component of the counterpart assembly for coupling said casing shoe to said second frame part;

wherein said casing shoe, said surface component of the counterpart assembly, and said second drilling means combine to feed the casing into the hole.

8. A drilling apparatus according to claim 2, further comprising a recess-projection surface assembly of the counterpart assembly, for coupling the second drilling means and the head of the casing to each other to allow free rotation of, and for limiting the longitudinal movement of, the second drilling means and the head of the casing in relation to each other.

* * * * *